US008033064B2

(12) United States Patent
Gaudreau

(10) Patent No.: US 8,033,064 B2
(45) Date of Patent: Oct. 11, 2011

(54) MULTI-PIECE POLYMER BUILDING PRODUCTS

(75) Inventor: Louis-Andre Gaudreau, Quebec (CA)

(73) Assignee: Novik, Inc., Saint-Augustin-de-Desmaures (CA)

( * ) Notice: Subject to any disclaimer, the term of this patent is extended or adjusted under 35 U.S.C. 154(b) by 82 days.

(21) Appl. No.: 12/326,528

(22) Filed: Dec. 2, 2008

(65) Prior Publication Data

US 2010/0132287 A1 Jun. 3, 2010

(51) Int. Cl.
*E06B 1/04* (2006.01)

(52) U.S. Cl. ..... 52/211; 52/58; 52/60; 52/97; 52/105

(58) Field of Classification Search ..... 52/29, 96, 52/105, 220.1, 220.8, 211, 302.1
See application file for complete search history.

(56) References Cited

U.S. PATENT DOCUMENTS

| | | | | |
|---|---|---|---|---|
| 4,156,272 | A | | 5/1979 | Wandler |
| 4,502,368 | A | | 3/1985 | Hempel |
| 4,520,976 | A | | 6/1985 | Cournoyer |
| 4,635,168 | A | | 1/1987 | Crowley |
| 4,726,152 | A | | 2/1988 | Vagedes |
| 4,842,155 | A | | 6/1989 | Begin, Jr. |
| 4,875,318 | A | * | 10/1989 | MacLeod et al. ..... 52/211 |
| 4,892,322 | A | | 1/1990 | Koza |
| 4,920,708 | A | | 5/1990 | MacLeod |
| 5,144,777 | A | | 9/1992 | Fishel |
| 5,303,522 | A | | 4/1994 | Vagedes |
| 5,326,060 | A | | 7/1994 | Chubb |
| 5,349,799 | A | * | 9/1994 | Schiedegger et al. ..... 52/473 |
| 5,365,707 | A | | 11/1994 | Jones |
| 5,397,093 | A | | 3/1995 | Chubb |
| 5,526,619 | A | | 6/1996 | Vagedes |
| 5,577,702 | A | | 11/1996 | Chubb |
| 5,596,852 | A | * | 1/1997 | Schiedegger ..... 52/212 |
| 5,598,670 | A | | 2/1997 | Humphrey |
| 5,775,032 | A | * | 7/1998 | Lacy ..... 52/28 |
| 5,918,431 | A | | 7/1999 | Schiedegger |

FOREIGN PATENT DOCUMENTS

| | | |
|---|---|---|
| CA | 1027730 | 3/1978 |

OTHER PUBLICATIONS

Novik "Jumbo Mounting Block A-500" Installation Guide, published at www.novik.com/documents/inst-a500.pdf.

* cited by examiner

*Primary Examiner* — Basil Katcheves
*Assistant Examiner* — Patrick Maestri
(74) *Attorney, Agent, or Firm* — Dickinson Wright

(57) ABSTRACT

A polymer building product for securement to the exterior of a building, the building product comprising a base portion securable to a substrate; a top portion slidingly telescopingly receivable over the base portion; and engaging elements, such as teeth, interengaging projections, etc. disposed on one or both of the base and top portions for securing the base and top portions together. The building product is characterized by a first, unsecured condition in which the top portion is slidingly received over the base portion in a first rotational orientation relative to the base portion and the top and base portions are freely slidingly separable, and a second, secured condition in which the top portion is slidingly received over the base portion in a second rotational orientation relative to the base portion and the top and base portions are secured together.

18 Claims, 5 Drawing Sheets

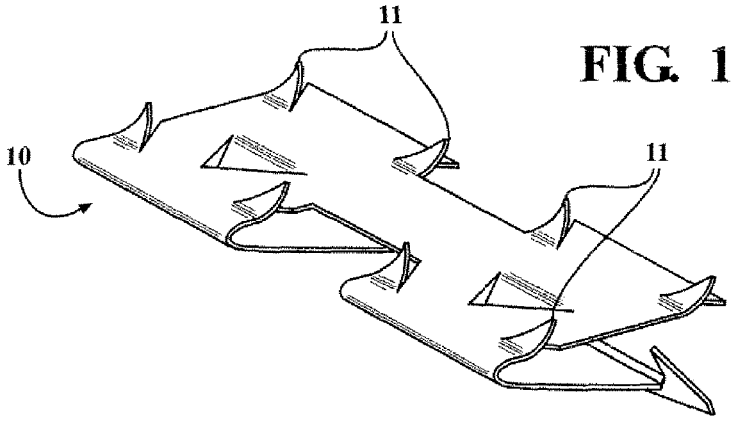
FIG. 1
FIG. 2
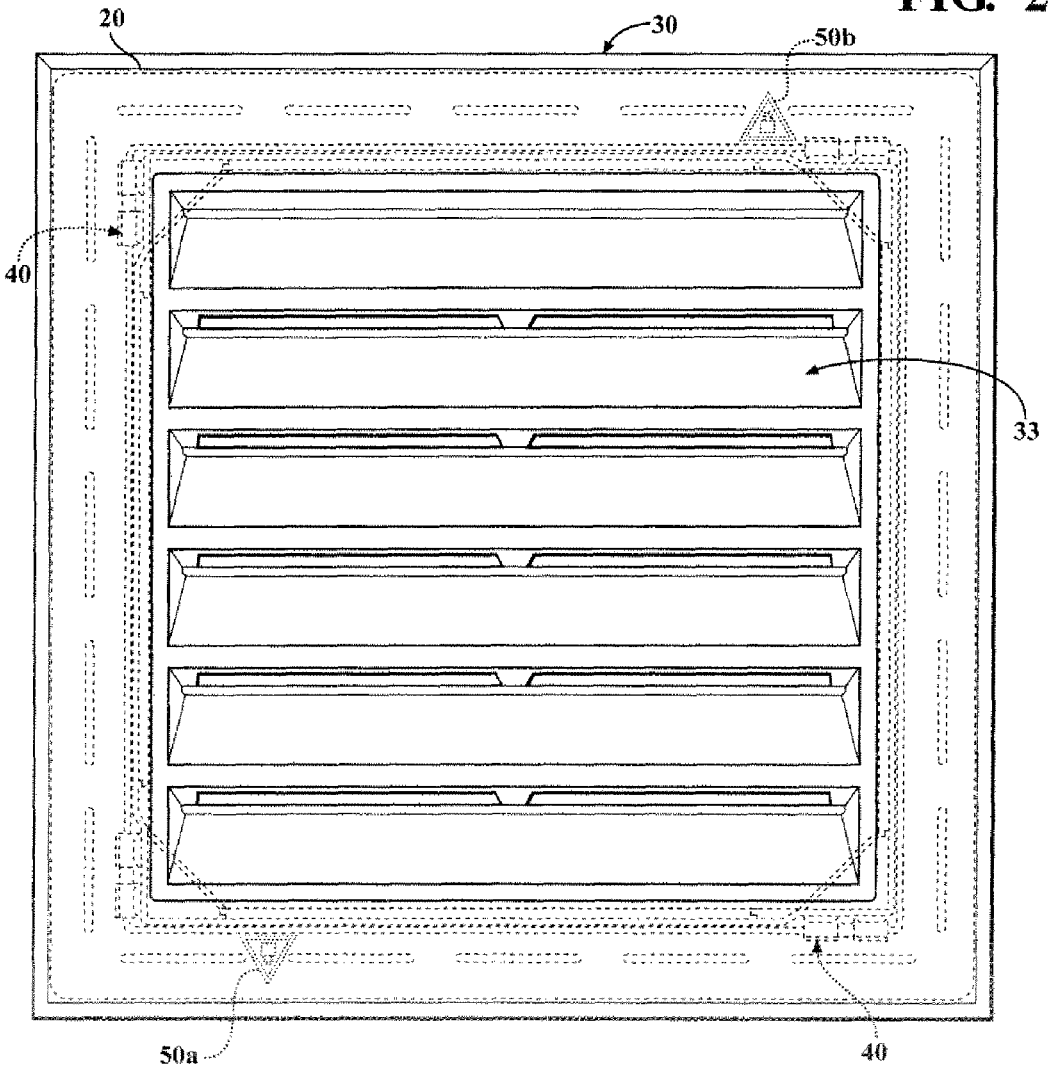

MULTI-PIECE POLYMER BUILDING PRODUCTS

FIELD OF THE INVENTION

The present invention pertains to the field of multi-piece polymer building products, such as, for example, multi-piece mounting blocks, vents, etc., and more particularly to improvements thereto which facilitate the shipping and installation of such products.

BACKGROUND

Polymer building products have long been known and are often utilized in residential and commercial construction. In addition to polymeric roofing and siding, such building products include wall and roof mounted, multi-part assemblies like mounting blocks, vents, etc. Mounting blocks, a generic descriptor, encompass exteriorly-mounted assemblies used to trim exterior fixtures such as electrical outlets, switches, light fixtures, exterior faucets, utilities' meters, etc. Exemplary mounting blocks are shown and described in, for instance, U.S. Pat. Nos. 4,920,708 and 6,429,371. Vents include exterior exhaust and intake assemblies, such as, for example, dryer vents, gable vents, roof vents, vents for kitchen and/or bathroom ventilation systems. Exemplary vents are shown and described in, for instance, U.S. Pat. Nos. 6,386,972, 5,729,935, and 4,875,318.

Conventionally, mounting block and vent assemblies alike are essentially characterized by a base portion which is affixed to the exterior surface—usually the substrate—of a residential or commercial building, and a decorative top or trim portion which is securely mated to the base portion following installation of roofing or siding about the base portion. The top portion, which in the case of vents may include the louvers or other ventilating openings therein (although these may also be provided in the base portion), serves in part to obscure any untidy appearance presented by the ends of the roofing or siding proximate the base portion. More particularly, and as exemplified in the U.S. Patents mentioned heretofore, the base portion of these multi-piece building products generally includes a peripheral flange adapted to abut and be fastened to (such as by nails or the like) the substrate of a structure, and an axial wall extending approximately perpendicularly from the flange so as to project outwardly away from the structure when the base portion is affixed to the substrate. As also exemplified in these patents, the top portion likewise includes an axial wall projecting approximately perpendicularly from a peripheral flange. The axial wall of the top portion is dimensioned so as to be telescopingly received over (either inside or outside of) the wall of the base portion in lapped relation thereto to define a mated condition of the base and top portions.

In order to secure the base and top portions together, there are conventionally provided complementary engaging means, such as the interlocking projections and recesses taught in U.S. Pat. No. 4,920,708. Alternatively, one or even both of the wall of the base portion and the wall of the top portion may be provided with projections adapted to bite into the wall of the other of the base or top portion in order to prevent separation of the base and top portions. According to one embodiment of these prior art means, exemplified in FIG. 1, metal clips 10 are attached to one or both walls of the base and/or top portions, each such clip including one or more "teeth" 11 projecting therefrom so as to engage the adjacent wall of the other of the base or top portions when the base and top portions are in the mated condition. These teeth 11 are angled so as to project upwardly toward the flange of the top portion when disposed on the top portion or, when disposed on the base portion, so as to project downwardly toward a flange of the base portion. The teeth 11 are, moreover, somewhat flexible so that they may be urged inwardly toward the associated base or top portion when the walls of the two portions are lapped. By virtue of the foregoing configuration, the teeth 11 do not interfere with the mating engagement of the top portion with the base portion, but do resist disengagement thereof by "biting" into the adjacent wall in response to any movement of the two portions away from each other.

While it is preferable for manufacturers to package the separate portions of mounting blocks, vents and like multi-piece building products in an assembled condition so to prevent loss of one portion or the other (i.e., top or base), the ability to do so is frustrated by the fact that the engaging means prevent ready disassembly of the products, including, as in the case of the clips heretofore described, without causing damage thereto. With respect particularly to the metallic dip interlocking-means described above in relation to FIG. 1, it has heretofore been the case that the clips were not secured to the building products by the manufacturer. Rather, the base and top portions of these products are packaged in an assembled condition with the clips simply being loosely disposed in the package to be secured to the wall of one or both of the base and top portions by a user at the time of product installation on a structure. Unfortunately, this solution often results in the loss of some or all of the "loose" clips before they can be attached to the base or top portions.

SUMMARY OF THE DISCLOSURE

The present invention addresses the foregoing problems of the prior art by the provision of polymer building products for securement to the exterior of a building, the building product comprising a base portion securable to a substrate, a top portion slidingly telescopingly receivable over the base portion, and engaging means disposed on one or both of the base and top portions for securing the base and top portions together. The building product is further characterized by a first, unsecured condition in which the top portion is slidingly received over the base portion in a first rotational orientation relative to the base portion and the top and base portions are freely slidingly separable, and a second, secured condition in which the top portion is slidingly received over the base portion in a second rotational orientation relative to the base portion and the top and base portions are secured together.

In one form thereof, the polymer building product is in the form of a vent, mounting block, etc., for mounting to the exterior of a building and concealing the edges of siding disposed adjacent the building product, and comprises a base portion having an axial wall bounding a central area, and a flange for securing the base portion to a substrate, the flange extending outwardly away from, and oriented generally perpendicularly with respect to, the axial wall; a top portion including an axial wall bounding a central area, the axial wall dimensioned to be receivable over the axial wall of the base portion in lapped relation therewith, and a substantially continuous peripheral flange extending outwardly away from, and oriented generally perpendicularly with respect to, the axial wall, the peripheral flange dimensioned so as to conceal the edges of siding disposed adjacent the base portion; and engaging elements disposed on the axial wall of one or both of the base and top portions for securing the base and top portions together when the axial wall of the top portion is telescopingly received over the axial wall of the base portion in lapped relation therewith. According to this form, the axial wall of one or both of the base and top portions is configured so as to provide clearance between that axial wall and the engaging elements disposed on the other of the axial wall of the base or top portions when the base and top portions are mated in a first rotational orientation of the top portion relative to the base portion, and to permit the engaging elements to secure the base and top portions together when the base and top portions are mated in a second rotational orientation of the top portion relative to the base portion.

According to one feature of the invention, the top portion is rotated 180 degrees relative to the base portion between the first and second rotational orientations.

Per another feature, indicia are provided on each of the base and top portions, the indicia cooperating to identify when the base and top portions are mated in one or both of the first and second rotational orientation.

According to another feature of the invention, the base portion comprises a flange securable to a substrate, and an axial wall extending generally perpendicularly away from the flange; the top portion includes an axial wall dimensioned to be telescopingly receivable over the wall of the base portion in lapped relation therewith, and a peripheral flange extending outwardly away from the axial wall of the top portion; and the engaging means are disposed on one or both of the base and top portions for securing the base and top portions together when the axial wall of the top portion is telescopingly received over the axial wall of the base portion in lapped relation therewith. The axial wall of one or both of the base and top portions is configured so as to provide clearance between that axial wall and the engaging means disposed on the other of the base or top portions when the top portion is received over the base portion in the first rotational orientation, and to permit the engaging means to secure the base and top portions together when the top portions is received over the base portion in the second rotational orientation.

Per still another feature of the invention, the axial wall of one or both of the base and top portions may be at least a substantially continuous wall characterized by a number of indentations corresponding in number to the number of engaging means disposed on the other of the base or top portions, the indentations being positioned along the axial wall so as to receive therein the engaging means disposed on the other of the base or top portions when the base and top portions are mated in the first rotational orientation.

BRIEF DESCRIPTION OF THE DRAWINGS

The present invention may be better understood with reference to the written description and drawings, of which:

FIG. 1 comprises a quartering perspective of a conventional (prior art) metal clip of the type attached to a wall of the base and/or top portions and incorporating metal teeth that engage the opposing wall to secure the base and top portions together;

FIG. 2 comprises a top view of a multi-piece vent in accordance with the present invention, shown in an "un-locked" or unsecured condition and with portions of the base being shown in phantom lines;

DETAILED DESCRIPTION

Figure 3:
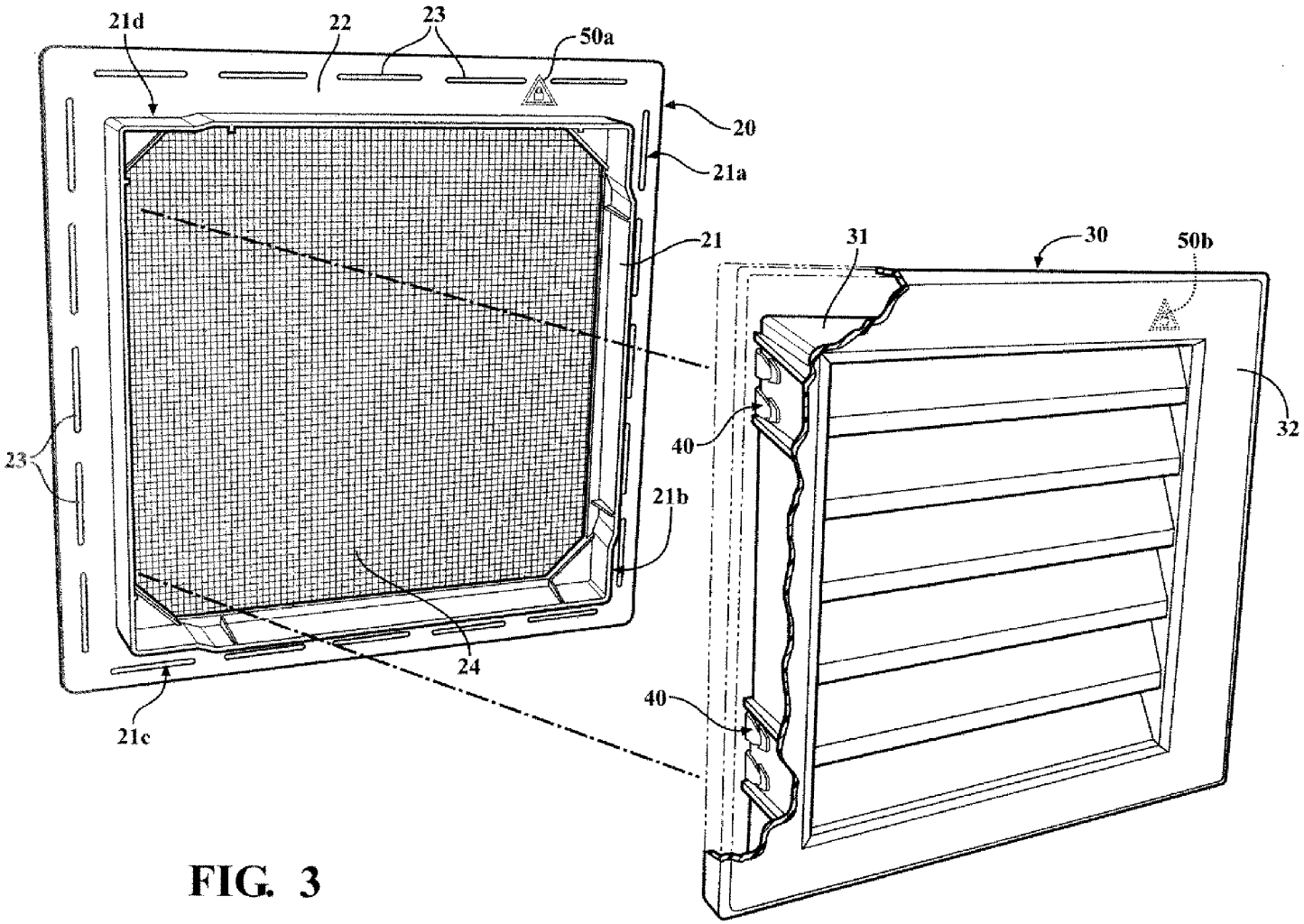
FIG. 3 comprises a quartering perspective view of the building product of FIG. 2, shown with the base and top portions thereof being separated and a portion of the top portion being cut away to show a part of the wall thereof.

Referring now to the drawings, wherein like numerals refer to like or corresponding parts, the present invention will be seen to most generally comprise a polymer building product comprising a base portion 20 securable to a substrate (not depicted), and a top portion 30 slidingly receivable over the base portion and selectively securable thereto by engaging means 40 disposed on one or both of the base and top portions. The building product is characterized by a first, unsecured (or "unlocked") condition in which the top portion is slidingly received over the base portion in a first rotational orientation relative to the base portion and the top and base portions are freely slidingly separable, and a second, secured (or "locked") condition in which the top portion is slidingly received over the base portion in a second rotational orientation relative to the base portion and the top and base portions are secured together.

More particularly according to the illustrated embodiment, base portion 20 includes a flange 22 securable to a substrate (not depicted), and an axial wall 21 extending generally perpendicularly away from the flange 22. Top portion 30 likewise includes an axial wall 31 dimensioned to be telescopingly receivable over the wall 21 of the base portion 20 in lapped relation therewith, and a peripheral flange 32 extending outwardly away from the axial wall 31.

The axial wall 21, 31 of one or both of the base 20 and top 30 portions, respectively, is, in the exemplary embodiment, configured so as to provide clearance between that wall 21 or 31 and the engaging means 40 disposed on the other of the base or top portions when the base and top portions are mated in a first rotational orientation (FIG. 2), and to permit the engaging means 40 to secure the base and top portions together when the base and top portions are mated in a second rotational orientation (FIG. 3).

As is shown best in FIG. 2, flange 22 is oriented generally perpendicular to, and extending outwardly away from, the axial wall 21. The flange 22, which may be continuous (as shown) or discontinuous about the perimeter of the wall 21, includes, also according to convention, openings, such as slots 23, therethrough for receiving fasteners (e.g., nails, screws, etc.) in order to secure the base portion to a substrate.

In the illustrated embodiment of FIGS. 2 through 6, according to which the building product depicted is a square-shaped gable vent, the base portion 20 further includes a screen mesh 24 of any of metal, fiberglass, etc., as is known for purposes of preventing insects and small animals from infiltrating a building through the vent.

Figure 4:
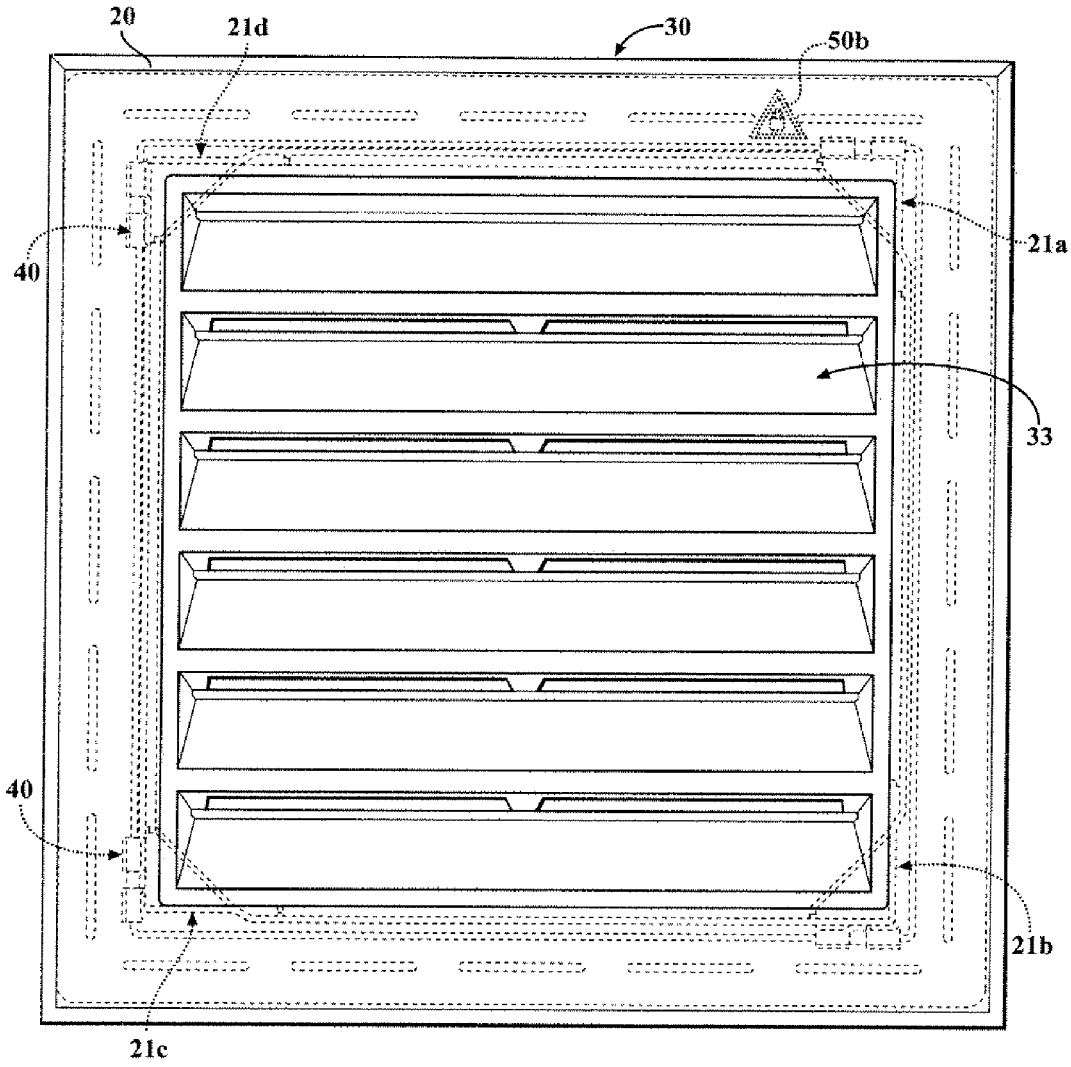
FIG. 4 comprises a top view of a multi-piece vent of FIG. 2, depicted in a "locked" or secured condition and with portions of the base being shown in phantom lines.
Figure 5:
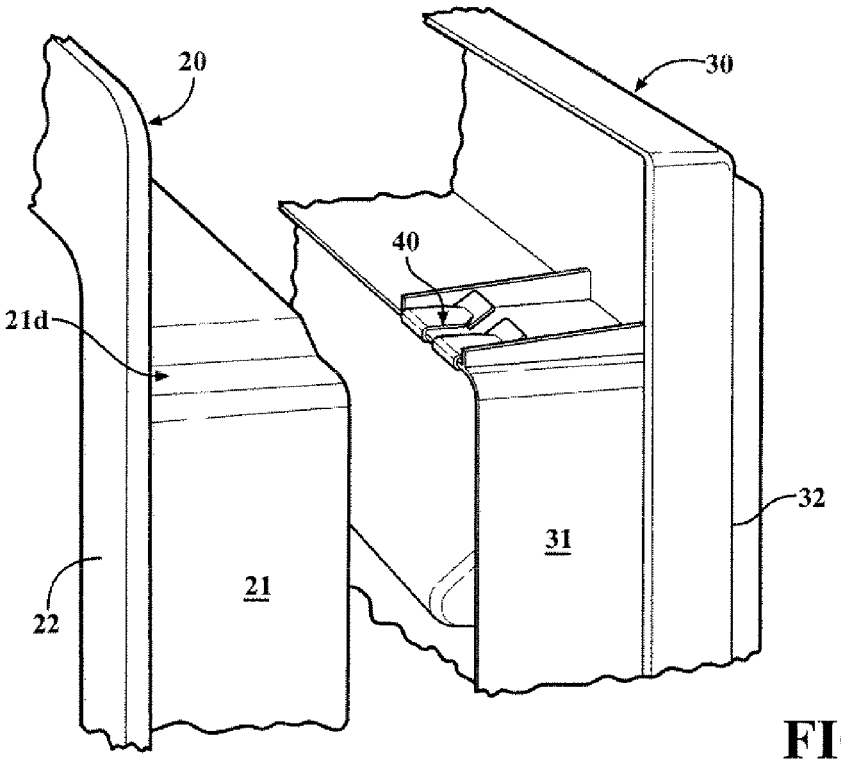
FIG. 5 is a detailed perspective view of the multi-piece vent of FIG. 2, showing portions of the base and top thereof aligned so as to mate in the "un-locked" condition.
Figure 6:
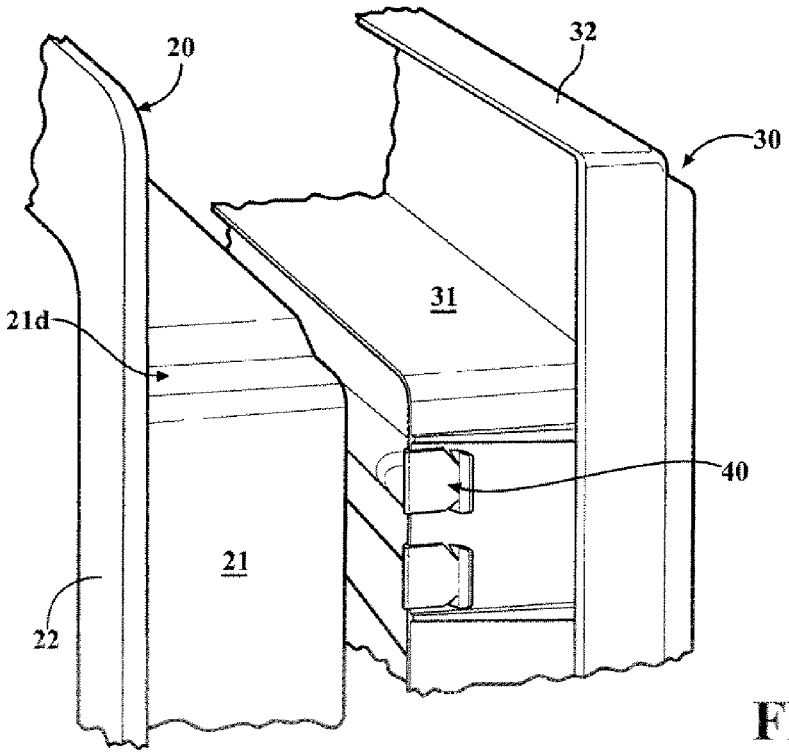
FIG. 6 is a detailed perspective view of the multi-piece vent of FIG. 2, showing portions of the base and top thereof aligned so as to mate in the "locked" condition.

With continuing reference to FIGS. 2 through 6, the axial wall 21 according to the illustrated embodiment of the invention may be seen to be characterized by a number of depressions or indentations 21*a*, 21*b*, 21*c*, 21*d* corresponding in position to the engaging means 40 when the base 20 and top 30 portions are mated in the first rotational orientation (FIGS. 2 and 5). In the form of the invention shown in FIG. 2, further to which the axial wall 31 of top portion 30 telescopingly slides over the outside surface of the wall 21 of base portion 20 so that the outside surface of axial wall 21 and the inside surface of axial wall 31 are in lapped relation, these depressions indentations in the wall 21 are recessed relative to the outside surface thereof. Of course, it will be understood that where the building product comprises base and top portions the walls of which are oppositely configured—such that the inside surface of the wall of the top portion slides over the outside surface of the wall of the base portion—these indentations would alternatively be recessed relative to the interior surface of the wall of the base portion.

Each such indentation 21*a*, 21*b*, 21*c*, 21*d* is of sufficient depth so as to receive therein, when the base 20 and top 30 portions are mated in a first rotational orientation (FIGS. 2 and 5) the engaging means 40 so as to provide clearance between the wall and the engaging means disposed on the other of the base or top portions when the base and top portions are mated in a first rotational orientation such that the engaging means do not engage the axial wall 21.

It is envisioned by the inventors hereof that the necessary clearance between the engaging means on one of the base or top portions and the axial wall of the other portion may be provided other than by the indentations as heretofore described in connection with the illustrated embodiments. For instance, and without limitation, it is contemplated that clearance may be ;provided in the form of cut-outs (not shown) through the axial wall, the cut-outs corresponding in position to the engaging means when the base and top portions are mated in a first rotational—"unlocked"—orientation so as to deny the engaging means any surface or complimentary structure to engage.

Figure 7:
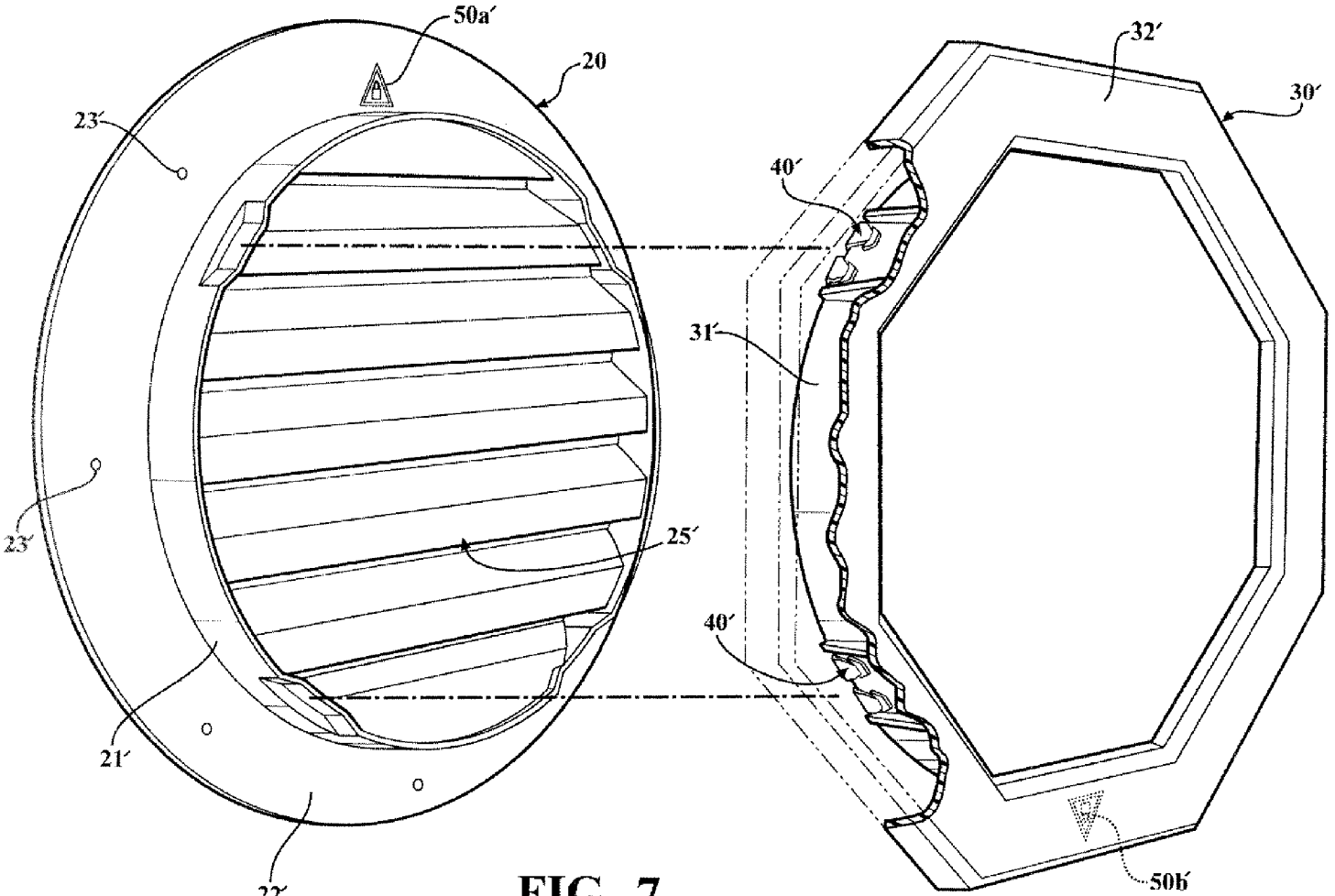
FIG. 7 comprises a quartering perspective view of a multi-piece gable vent in accordance with the present invention, with the base and top portions thereof being separated and a part of the top portion being cut away to show the wall thereof.

With continuing reference to FIGS. 2 through 6, the top portion 30 includes, as indicated previously, an axial wall 31 dimensioned to be receivable over the axial wall 21 of the base portion 20 in lapped relation therewith, and a peripheral flange 32 oriented generally perpendicular to, and extending outwardly away from, the axial wall 31. As is known, peripheral flange 32 is generally of sufficient dimensions to obscure the untidy appearance presented by the ends of the roofing or siding proximate the base portion 20 after the product is installed on a structure. According to the illustrated embodiment of FIGS. 2 through 6, in which there is shown a square gable vent, the central area bounded by the axial wall 31 includes louvers 33. However, it will be understood that the present invention is neither limited by the configuration of the flange 32 or the presence of absence of louvers 33. Rather, and as those skilled in the art will appreciate with the benefit of this disclosure, the present invention may be incorporated into mounting blocks, vents and comparable multi-part polymer building products of varying dimensions, shapes and utilities. Thus, for instance, there is shown in FIG. 7 an alternative embodiment of the present invention according to which the polymer building product comprises a gable vent with a top portion 30' having an octagonally-shaped flange 32' and a circular-shaped axial wall 31'. In this embodiment, the louvers 25' are provided on the base portion 20' interiorly of the central area bounded by a circular-shaped axial wall 21'. A circular-shaped peripheral flange 22' with openings 23' therethrough permits the base portion's attachment to a substrate (not shown).

With particular reference to FIGS. 1, 4 and 5, the engaging means 40 of the illustrated embodiment comprise engaging elements such as at least one tooth disposed on the axial wall of one or both of the base and/or top portions for *engaging the axial wall of the other of the base and/or top portions so as to resist separation of the base and top portions after the axial wall of the top portion is received over the axial wall of the base portion in lapped relation therewith. More particularly, the invention as depicted comprises such teeth formed as part of metal clips 10 which are generally U-shaped in cross-section so as to be received over the upper edge of axial wall 31, as is known. Each such dip 10 is, as previously described in reference to FIG. 1, characterized by a plurality of teeth 11 angled so as to project upwardly toward the flange of the top portion when disposed on the top portion (as in the illustrated embodiment) or, when disposed on the base portion, so as to project downwardly toward the flange of the base portion. The teeth 11 are resiliently flexible so that they may be urged inwardly toward their associated base or top portion when the walls of the two portions are lapped. By virtue of this configuration, the teeth 11 do not interfere with the mating engagement of the top and base portions, but do resist disengagement thereof by "biting" into the adjacent axial wall in response to any movement of the two portions away from each other.

While the engaging means 40 of the illustrated embodiments are shown to comprise metal clips 10 as described heretofore, it is contemplated by the inventors hereof that the present invention is equally suited to multi-piece building products wherein the engagement means comprise, for example and without limitation, interengaging projections known in the art, such as those described in U.S. Pat. No. 4,920,708 (circumferentially and axially spaced grooves provided on the axial wall of the top and/or bottom portions which are selectively engaged by axially spaced projections provided on the axial wall of the other of the top and/or bottom portions), U.S. Pat. No. 4,875,318 (one or more teeth disposed on the axial wall of the top and/or bottom portions and a plurality of circumferentially spaced, complementary recesses or grooves disposed in the surface of the axial wall of the other of the top and/or bottom portion), U.S. Pat. No. 5,729,935 (shoulder portions projecting from the axial wall of the top and/or bottom portions and which engage with the grooves disposed in the surface of the axial wall of the other of the top and/or bottom portion), and U.S. Pat. No. 5,326,060 (a plurality of spaced recesses provided in the axial wall of the top and/or bottom portions and which selectively receive teeth or locator locks disposed on the axial wall of the other of the top and/or bottom portions), the disclosures of which patents are incorporated herein by reference in their entireties.

Referring now to FIGS. 2 through 6, the operation and manner of employment of the present invention will be better understood.

As described previously, it is desirable to package and ship multi-piece building products such as mounting blocks, vents, etc. in a condition where the base and top portions are mated. To facilitate this, while still permitting the end-user to readily separate the base and top portions when required for installation, top portion 30 of the present invention is aligned in a first rotational orientation relative to the base portion 20—also referred to as an "unlocked" condition—according to which the respective engaging means 40 are received in each of indentations 21*a*, 21*b*, 21*c*, 21*d* (FIGS. 1 and 4). Prior to installation of the building product, the base 20 and top 30 portions are slidingly separated from each other and, according to convention, the base portion 20 is secured to a substrate and siding or roofing laid in proximity thereto. Thereafter, the top portion 30 is slidingly telescopingly received over the base portion 20 with the respective axial walls 21, 31 thereof in lapped relation. To ensure that the engaging means 40 function to secure the base 20 and top 30 portions together, top portion 30 of the present invention is rotated relative to the first, "unlocked" orientation so as to be aligned in a second rotational orientation relative to the base portion 20—also referred to as a "locked" condition—according to which the engaging means 40 are not received in any of depressions 21*a*, 21*b*, 21*c*, 21*d* (FIGS. 2, 3 and 5) but instead are brought into contact with the axial wall 21.

As depicted in the embodiment of FIGS. 2-6, wherein the building product is characterized by generally parallelogram-shaped axial walls 21, 31, between the first and second rotational orientations the top portion 30 is rotated 180 degrees relative to the base portion 20. According to the embodiment of FIG. 7, wherein the building product is characterized by generally circular-shaped axial walls 21', 31', it will be appreciated that relative rotation of the base 20' and top 30' portions of 180 degrees between the "locked" and "unlocked" conditions is possible only where there are provided an odd number of engaging means, or where the depressions are not symmetrically spaced about the axial wall. Otherwise, the relative rotation of the base 20' and top 30' portions between the "locked" and unlocked" conditions will be other than 180 degrees.

To assist a user in properly aligning the base 20 and top 30 portions in one or both of the "locked" and "unlocked" conditions, the present invention may further include indicia 50*a*, 50*b* (50*a*', 50*b*' in the embodiment of FIG. 7) on each of the base 20 and top 30 portions which cooperate to identify when the base and top portions are mated in one or both of these orientations. In the illustrated embodiments, these indicia 50*a*, 50*b* more particularly comprise corresponding geometric shapes with the symbol of a locked padlock therein. As desired, the indicia 50*b* provided on the top portion 30 may be positioned on a rear surface of the top portion so as to not be visible when the building product is fully installed.

In the "unlocked" condition of the building product, these indicia 50*a*, 50*b* are axially misaligned, such as shown in FIG. 2. Conversely, in the "locked" condition of the building product these indicia 50*a*, 60*b* are axially aligned, as shown in each of FIGS. 2 and 3. Thus, by rotating the top portion 30 so that the indicia 50*a* are aligned with the indicia 50*b* of the base portion 20, a user will be assured that the top portion will be securely attached to the base portion when the top portion is urged onto the base portion.

Alternatively, or in addition, it is contemplated that indicia may be provided to indicate the proper relative alignment of the base and top portions in the "unlocked" condition. Thus, for example, there may be provided a set of corresponding indicia on each of the base and top portions which, when axially aligned, signify to the user that the base and top portions are in the "unlocked" condition thereof.

It will be appreciated from the foregoing disclosure that the present invention provides multi-part polymer building products which facilitate the accurate and rapid installment thereof.

Of course, the preceding specification is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A polymer building product for securement to the exterior of a building, the building product comprising:

a base portion securable to a substrate;

a top portion slidingly telescopingly receivable over the base portion;

engaging means disposed on one or both of the base and top portions for securing the base and top portions together;

wherein the building product is characterized by a first, unsecured condition in which the top portion is slidingly received over the base portion in a first rotational orientation relative to the base portion and the top and base portions are freely slidingly separable, and a second, secured condition in which the top portion is slidingly received over the base portion in a second rotational orientation relative to the base portion and the top and base portions are secured together;

wherein one or both of the base and top portions provides clearance between the engaging means disposed on the other of the base or top portions when the base and top portions are mated in the first rotational orientation, whereby the engaging means do not contact the other of the base or top portions, and wherein the engaging means cooperate with the other of the base or top portions in the second rotational orientation to secure the base and top portions together; and wherein the top portion is oriented in each of the first and second rotational orientations thereof before the top portion is slidingly received over the base portion.

2. The polymer building product of claim 1, wherein, between the first and second rotational orientations, the top portion is rotated 180 degrees relative to the base portion.

3. The polymer building product of claim 1, further comprising indicia on each of the base and top portions which cooperate to identify when the base and top portions are mated in one or both of the first and second rotational orientations.

4. The polymer building product of claim 1, wherein the base portion comprises a flange securable to a substrate, and an axial wall extending generally perpendicularly away from the flange, the top portion includes an axial wall dimensioned to be telescopingly receivable over the wall of the base portion in lapped relation therewith, and a peripheral flange extending outwardly away from the axial wall of the top portion, the engaging means are disposed on one or both of the base and top portions for securing the base and top portions together when the axial wall of the top portion is telescopingly received over the axial wall of the base portion in lapped relation therewith, and wherein the axial wall of one or both of the base and top portions is configured so as to provide clearance between that axial wall and the engaging means disposed on the other of the base or top portions when the top portion is received over the base portion in the first rotational orientation, and to permit the engaging means to secure the base and top portions together when the top portions is received over the base portion in the second rotational orientation.

5. The polymer building product of claim 4, wherein the axial wall of one or both of the base and top portions is at least a substantially continuous wall characterized by a number of indentations corresponding in number to the number of engaging means disposed on the other of the base or top portions, the indentations being positioned along the axial wall so as to receive therein the engaging means disposed on the other of the base or top portions when the base and top portions are mated in the first rotational orientation.

6. The polymer building product of claim 5, further comprising indicia on each of the base and top portions which cooperate to identify when the base and top portions are mated in one or both of the first and second rotational orientations.

7. The polymer building product of claim 5, wherein, between the first and second rotational orientations, the top portion is rotated 180 degrees relative to the base portion.

8. The polymer building product of claim 4, further comprising indicia on each of the base and top portions which cooperate to identify when the base and top portions are mated in one or both of the first and second rotational orientations.

9. The polymer building product of claim 4, wherein, between the first and second rotational orientations, the top portion is rotated 180 degrees relative to the base portion.

10. A polymer building product for mounting to the exterior of a building and concealing the edges of siding disposed adjacent the building product, the building product comprising:

a base portion having an axial wall bounding a central area, and a flange for securing the base portion to a substrate, the flange extending outwardly away from, and oriented generally perpendicularly with respect to, the axial wall;

a top portion including an axial wall bounding a central area, the axial wall dimensioned to be receivable over the axial wall of the base portion in lapped relation therewith, and a substantially continuous peripheral flange extending outwardly away from, and oriented generally perpendicularly with respect to, the axial wall, the peripheral flange dimensioned so as to conceal the edges of siding disposed adjacent the base portion;

engaging elements disposed on the axial wall of one or both of the base and top portions for securing the base and top portions together when the axial wall of the top portion is telescopingly received over the axial wall of the base portion in lapped relation therewith;

where the axial wall of one or both of the base and top portions is configured so as to provide clearance between that axial wall and the engaging elements disposed on the other of the axial wall of the base or top portions so that the engaging elements do not contact the other of the base or top portions when the base and top portions are mated in a first rotational orientation of the top portion relative to the base portion, and to permit the engaging elements to secure the base and top portions together when the base and top portions are mated in a second rotational orientation of the top portion relative to the base portion; and wherein the top portion is oriented in each of the first and second rotational orientations thereof before the top portion is slidingly received over the base portion.

11. The polymer building product of claim 10, further comprising indicia on each of the base and top portions which cooperate to identify when the base and top portions are mated in one or both of the first and second rotational orientations.

12. The polymer building product of claim 10, wherein, between the first and second rotational orientations, the top portion is rotated 180 degrees relative to the base portion.

13. The polymer building product of claim 10, wherein the flange of the base portion is a substantially continuous peripheral flange.

14. The polymer building product of claim 10, wherein the axial wall of one or both of the base and top portions is at least a substantially continuous wall characterized by a number of indentations corresponding in number to the number of engaging elements disposed on the other of the base or top portions, the indentations being positioned along the axial wall so as to receive therein the engaging elements disposed on the other of the base or top portions when the base and top portions are mated in the first rotational orientation.

15. The polymer building product of claim 14, further comprising indicia on each of the base and top portions which cooperate to identify when the base and top portions are mated in one or both of the first and second rotational orientations.

16. The polymer building product of claim 14, wherein, between the first and second rotational orientations, the top portion is rotated 180 degrees relative to the base portion.

17. The polymer building product of claim 16, further comprising indicia on each of the base and top portions which cooperate to identify when the base and top portions are mated in one or both of the first and second rotational orientations.

18. The polymer building product of claim 10, wherein the engaging elements comprise teeth projecting away from the axial wall on which they are disposed, the teeth biting into the other axial wall to resist sliding disengagement of the base and top portions.

* * * * *

UNITED STATES PATENT AND TRADEMARK OFFICE
Certificate

Patent No. 8,033,064 B2 Patented: October 11, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Louis-André Gaudreau, Quebec (CA); Michel Gaudreau, Quebec (CA); François Bouchard, Quebec (CA); and Martin Forget, Quebec (CA).

Signed and Sealed this Seventh Day of January 2014.

BRIAN GLESSNER
Supervisory Patent Examiner
Art Unit 3633
Technology Center 3600